United States Patent [19]

Lazarski

[11] Patent Number: 5,007,185

[45] Date of Patent: Apr. 16, 1991

[54] CLEAT COVER FOR BUCYCLE SHOE

[76] Inventor: Margaret A. Lazarski, P.O. Box 6594, Denver, Colo. 80206

[21] Appl. No.: 421,448

[22] Filed: Oct. 13, 1989

[51] Int. Cl.[5] ..... A43B 5/00

[52] U.S. Cl. ..... 36/135; 36/131; 36/7.5

[58] Field of Search ..... 36/135, 131, 7.5

[56] References Cited

U.S. PATENT DOCUMENTS

| | | | |
|---|---|---|---|
| 1,340,356 | 8/1920 | Yarnell et al. | 36/7.5 |
| 4,055,005 | 10/1977 | Meinhart | 36/135 |
| 4,183,157 | 1/1980 | Counselman | 36/135 |
| 4,807,372 | 2/1989 | McCall | 36/135 |
| 4,872,273 | 10/1989 | Smeed | 36/7.5 |

FOREIGN PATENT DOCUMENTS

| | | | |
|---|---|---|---|
| 0574265 | 12/1945 | United Kingdom | 36/7.5 |

*Primary Examiner*—Paul T. Sewell
*Assistant Examiner*—Ted Kavanaugh
*Attorney, Agent, or Firm*—Ralph F. Crandell

[57] ABSTRACT

A cleat cover for use on a bicycle shoe equipped with a pair of bicycle pedal engaging shoe cleats. The cleat cover is formed as an elastomeric shallow oval cup shaped housing for engaging, covering and protecting said front and rear cleats. The cup-shaped housing defines a parabolic toe portion cup for receiving the front cleat, and a rectangular heel portion cup for snugly receiving and covering the rear cleat. The cleats are enclosed and protected by the cover to adapt the bicycle shoe for temporary use as a walking shoe.

9 Claims, 2 Drawing Sheets

CLEAT COVER FOR BUCYCLE SHOE

BACKGROUND OF THE INVENTION

1. Field Of The Invention

The present invention relates to cleat covers for bicycle shoes and more specifically to removable walking covers for pedal engaging cleats on bicycle shoes.

Cleated bicycle shoes embody one or more cleats adapted to engage with a mating mechanism on a bicycle pedal. One illustrative cleat construction includes two spaced cleats secured to a sole plate of a bicycle shoe, each cleat having a forwardly directed lip adapted for releasable engagement in corresponding slots or apertures in a bicycle pedal. The present invention relates to a cover.

2. Statement Of The Prior Art

Since the advent of the cleated pedal engaging bicycle shoe cleat covers have been provided for the cleats in order to permit the cyclist to dismount from the bicycle and engage in limited walking activities without removing the cleated shoes. See for example, U.S. Pat. No. 4,807,372, issued Feb. 28, 1989, to H. L. McCall for "Cleated Shoe Walking Sole," and U.S. Pat. No. 4,055,005, issued Oct. 25, 1977 to R. H. Meinhart for "Cover for Bicycling Shoe to Provide a Walking Surface." Without such a cover the pedal engaging cleats can be severally damaged or worn, and the cleats are difficult and uncomfortable to walk on. For example, if a cyclist needs to dismount for personal reasons, to change a tire, or to walk up a hill or traverse difficult terrain for short distances, it is necessary to provide some kind of cover for the cleats on the bottom of the shoe. Most cyclists do not wish to carry and change into an extra set of shoes where the stop is only momentary. For this reason various forms of cleat covers have been developed, the principal form of which simply comprises a cover having a peripheral wall with means to engage the cleats and hold the cover on the shoe. Such covers, though useful can readily twist or slip off of the cleats or are difficult to take on or off of the cleats. Some covers tend to slip off of the cleats as a result of the natural twisting movement of the foot when walking. Others are like overshoes and are excessively large and cumbersome.

OBJECT AND SUMMARY OF THE INVENTION

It is the principal object of the present invention to provide an improved cover for covering the pedal engaging cleats on the sole plate of a bicycle shoe.

Another object of the invention is to provide a cleat cover which is rugged, durable and light weight.

A further object of the present invention is to provide a cleat cover of the foregoing character which is small, compact and easily attachable to a bicycle seat or easily carried in a pocket or pack.

Still another object of the present invention is to provide a cleat cover of the foregoing type which can be securely mounted on the cleats, will not twist off so that the user can walk with the cleats covered, and yet is easily slipped on and off of the cleats for convenience in use.

Still a further object of the present invention is to provide a cleat cover which tightly engages the cleats and is comfortable to walk on.

Other objects and advantages of the present invention will become apparent as the following description proceeds.

Cleat covers embodying the present invention find particular but not necessarily exclusive utility for covering bicycle pedal engaging cleats of the type including front and rear cleat members mounted on the sole plate of a bicycle shoe with pedal engaging lips extending forwardly or towards the toe of the shoe. The shoe cleats are spaced apart and positioned generally on opposite sides of the position of the ball of the wearer's foot within the shoe. The forward or front cleat includes a forwardly directed lip, while the rear cleat, the cleat towards the heel of the foot, includes both a forwardly directed lip and a rearwardly directed notch, the lips and notch being engageable with a mating bicycle pedal construction.

The cleat cover embodying the present invention is in the form of a removable elastomeric shallow cup-shaped housing for engaging, covering and protecting the front and rear cleats. The cup-shaped housing is formed in a generally oval shape with a base and a narrow upstanding peripheral wall extending around the base. At a point intermediate its ends the cover is provided with a transverse wall which divides the cup shaped cover into a forwardly, generally parabolic cup adapted to receive and cover the front cleat, and a heel or rear generally rectangular cup adapted to receive and cover the heel or rear cleat. At its front portion the cover is provided with an arcuate lip integral with the peripheral wall and extending rearwardly overlying the base to define an arcuate groove adapted to receive the forwardly extending lip and engage a convex wall on the front cleat. The transverse wall defines a rearwardly extending lip integral with the transverse wall and extending into the rectangular cup portion and overlying the base to define a generally rearwardly directed transverse groove adapted to receive the forwardly extending lip on the rear cleat. The rear wall of the rectangular cup slopes downwardly and inwardly and is provided at its outer upper rear edge with a forwardly directed rib adapted to releasably engage in the rearward notch in the body of the rear cleat.

The engagement of the front cleat lip in the cover groove and the rear cleat lip in the transverse groove together with the engagement of the rib in the rearwardly directed cleat groove, together with the snug engagement of the front cleat by the parabolic arcuate wall, and the snug engagement of the rear cleat by the rectangular cup, holds the cover securely on the cleats and yet allows the cover to be readily removed.

DESCRIPTION OF THE PREFERRED EMBODIMENT

Figure 1:
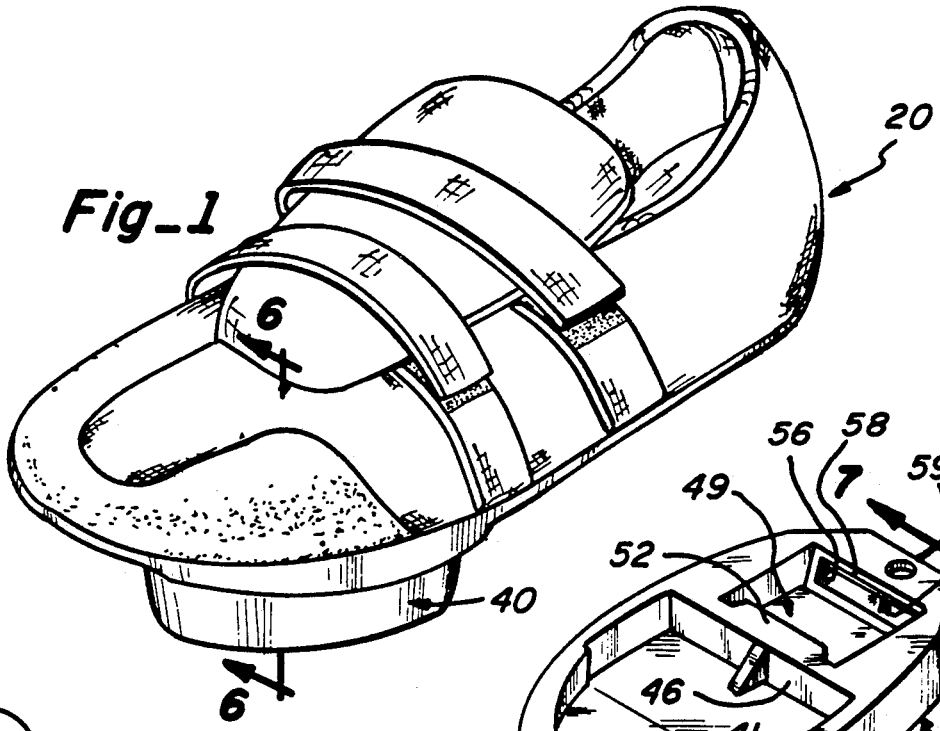
FIG. 1 is an isometric view of a cleated bicycle shoe with an affixed cleat cover embodying the present invention.

Bicycle pedal engaging cleats on bicycle shoes take a variety of forms and configurations. In one form a bicycle shoe 20 is provided with a sole plate 21 mounting a pair of spaced apart cleats, a front cleat 22 and a rear cleat 24. The cleats are aligned generally in the longitudinal direction of the shoe and are secured to the sole plate by appropriate screws. The front cleat is formed by a cleat body 25 mounted in a recess in the sole plate 21. The body 25 is provided with a forwardly extending lip 29 overlying the sole plate and defining with the sole plate 21 a forwardly facing groove 30.

The rear cleat 24 is formed by a body 31 adapted to be received in a recess 34 in the sole plate 21. The rear cleat 24 is provided with a forwarding extending lip 35 overlying and defining with the sole plate 21 a forwardly facing rear groove or channel 36. At its rear wall the body 31 is formed with a rearwardly extending rib 38 forming a notch 39 adjacent the sole plate 21. The cleats 22, 24 are shaped to provide the desired mounting with the mounting structure (not shown) of the bicycle pedal (not shown).

Figure 4:
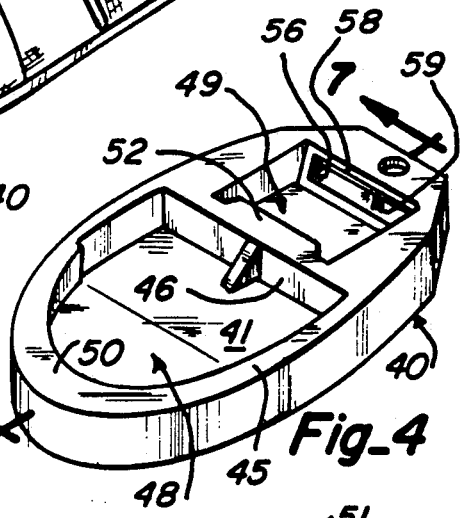
FIG. 4 is an isometric top view of a cleat cover embodying the present invention.
Figure 2:
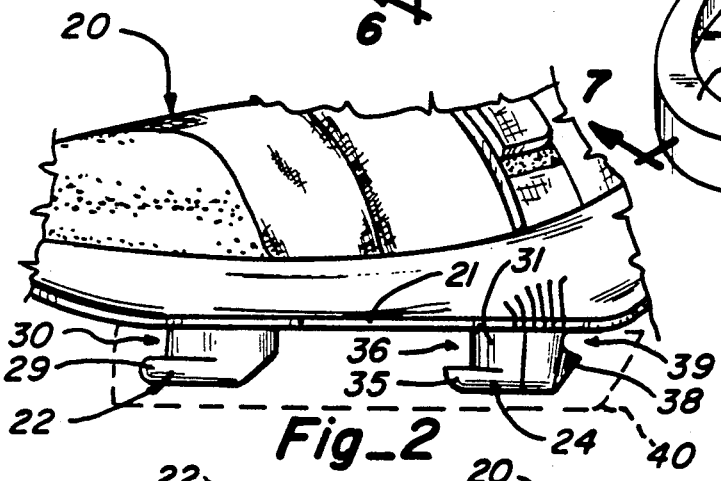
FIG. 2 is a partial elevational view of the cleated bicycle shoe shown in FIG. 1 with a cleat cover shown in phantom.
Figure 3:
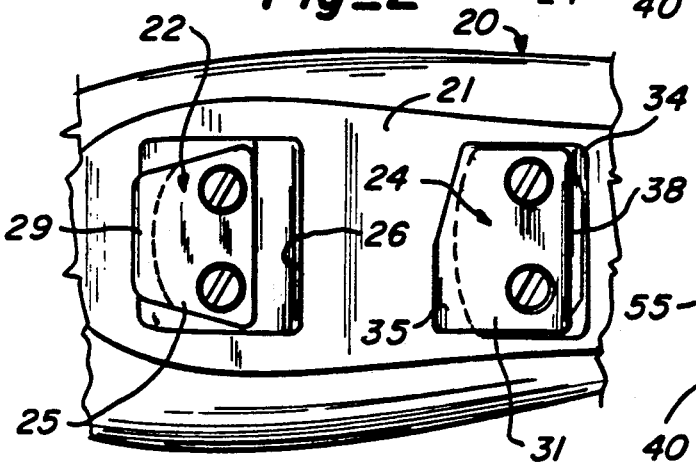
FIG. 3 is a bottom plan view of the cleated bicycle shoe shown in FIG. 2.
Figure 5:
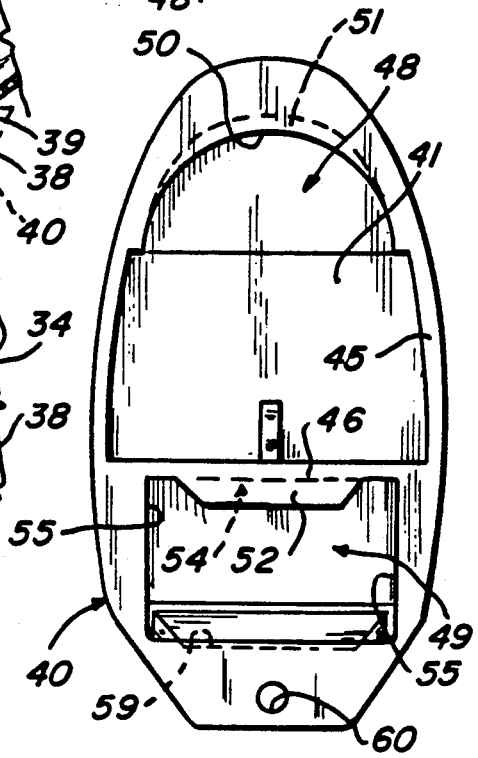
FIG. 5 is an enlarged top plan view of the cleat cover shown in FIG. 4.
Figure 6:
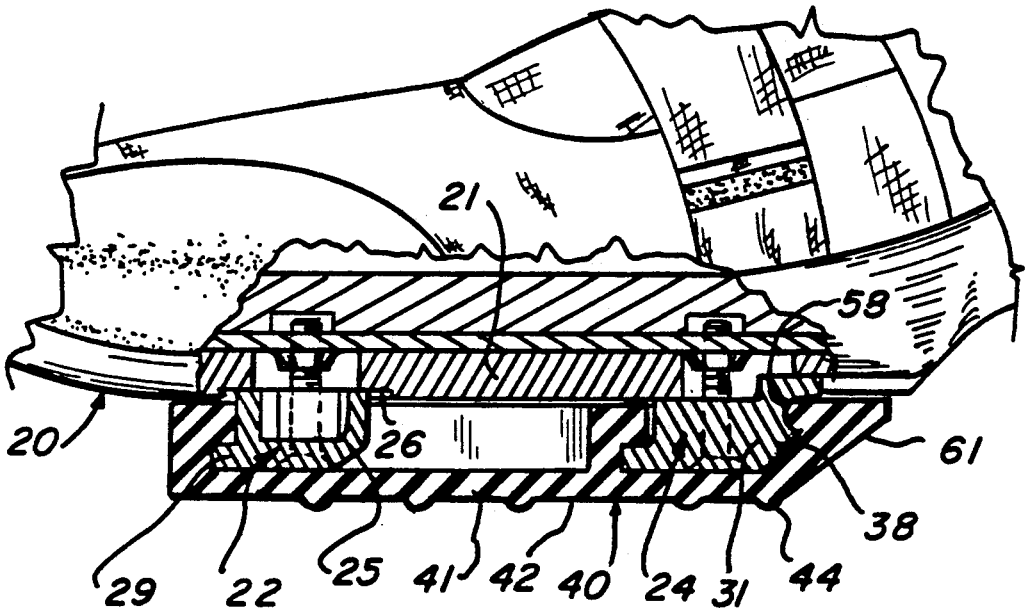
FIG. 6 is a section view taken substantially in the plane of line 6—6 on FIG. 1.
Figure 7:
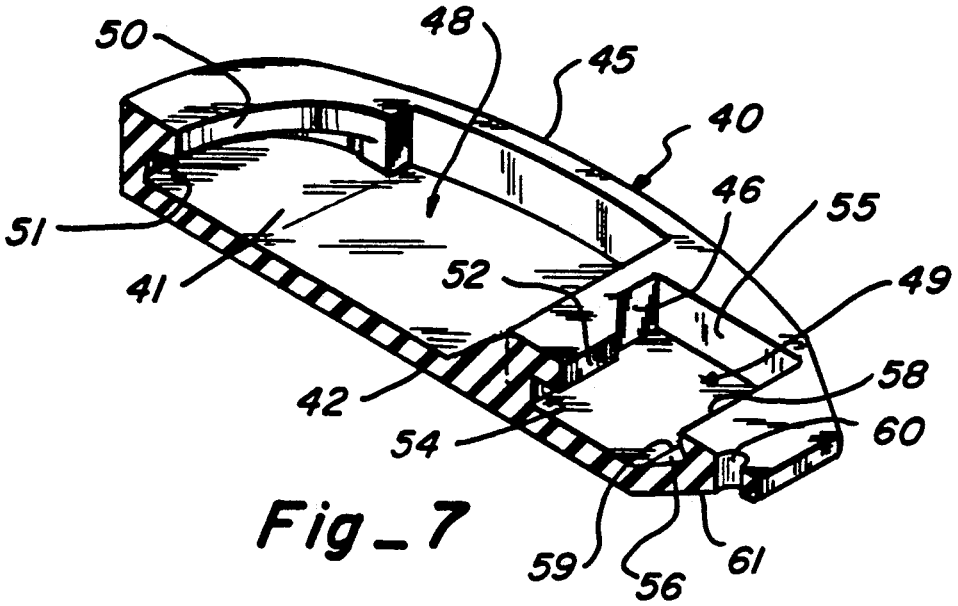
FIG. 7 is a section view taken substantially in the plane of line 7—7 on FIG. 4.

In order to provide a protective cover for the cleats which enables the shoe wearer to walk on the cleats without damaging them after dismounting from the bicycle, the present invention contemplates a relatively flat, shallow, elongated cover 40 adapted to releasably engage the cleats utilizing the cleat structure to hold the cover on the bottom of the shoe. To this end the cleat cover 40 embodying the present invention as shown in FIGS. 4, 5 and 7 of the drawings comprises a generally oval shaped elongated base panel 41 provided with a tread surface 42 with integrally formed ribs, knobs or equivalent tread 44 the tread surface generally constituting the bottom of the base panel 41. On its upper surface the base panel is provided with a narrow peripheral wall 45 defining with the base panel 41 a shallow cup shaped housing. A transverse wall 46 divides the cover into a forward generally parabolic shaped cup 48 for receiving the front shoe cleat 22 and a rear generally rectangular cup 49 for receiving and enclosing the rear shoe cleat 24. For engaging with the front shoe cleat 22, the forward parabolic cup 48 is provided adjacent its forward or front wall with an arcuate lip 50 integral with the wall 45 and overlying the base panel 41 to define an arcuate groove 51 adapted to receive the forwardly extending lip 49 of the front cleat 22. The arcuate lip 50 engages in the front cleat notch 30 to retain the front cleat within the parabolic cup 48.

For engaging the forwardly extending lip 35 of the rear cleat 24, a generally transverse lip 52 on the transverse wall 46 extends into the rectangular cup 49 and defines a groove 54 adapted to receive the forwarding extending lip 35 of the rear cleat with the cover lip 52 extending into the corresponding cleat groove 36. The engagement of the cleat lip 35 below the cover lip 52 serves to secure the rear cleat within the rectangular cup. The sidewalls 55 of the rectangular cup engage and confine the body 31 of the rear cleat.

For further holding the rear cleat within the rectangular covered cup 49 the rectangular cup is provided with a rearwardly sloping wall 56 terminating adjacent the upper surface of the cover in a forwardly extending rib 58 adapted to engage in the notch 39 formed by the rib 38 of the rear cleat body 31. The rib 58 defines with the sloping wall 56 a groove or notch 59 into which the cleat rib 38 projects when the cleat cover is mounted in place thereby securely holding the cover on the cleats to prevent the cover from being accidentally dislodged as the shoe wearer walks on the covered cleats. The rectangular cup confines the rear cleat 24 to prevent the cover from being twisted off of the cleats as a result of the natural twisting action of the wearer's foot when walking.

For convenience in holding, retaining or storing the cleat covers each cover is provided with a retainer receiving aperture 60 adjacent its rear edge. To provide for further comfort and ease of walking the rear surface 61 of the base 41 slopes upwardly thereby preventing the feel of a ridge or bump on the bottom of the shoe and facilitate standing and walking on the covered cleats. The cleat covers are formed of the generally elastomeric material such as a rubber of plastic of sufficient stiffness to securely engage the shoe cleats and yet be sufficiently resilient to enable the covers to be snapped on and off of the shoe. At the same time the covers must provide a rugged wear resistant walking surface which enables the shoe wearer to either stand, walk or sometimes run for short distances. For example the cleat material may be a hard but flexible rubber or plastic composition.

While a certain illustrative embodiment of the present invention has been shown in the drawings and described above in considerable detail it should be understood that there is no intention to limit the invention to the specific construction shown. On the contrary the intention is to cover all modifications, alternative constructions, equivalents and uses falling within the spirit and scope of the invention as expressed in the appended claims.

I claim:

1. A cleat cover for use on a bicycle shoe equipped with a pair of bicycle pedal engaging shoe cleats defining spaced apart longitudinally aligned front and rear cleats mounted on a sole plate of said bicycle shoe, each cleat having a body portion defining a forwardly extending lip overhanging the sole plate and the rear cleat further defining a rearwardly directed notch adjacent the sole plate, said cleat cover comprising a removable elastomeric shallow cup shaped housing for surrounding and covering said front and rear cleats, means on said housing for releasably engaging the forwardly extending lip of each of said cleat and securing said housing to said cleats, and means on said housing for releasably engaging within the rearwardly directed notch of said rear cleat, said lip engaging means and notch engaging means releasably gripping and securing said cover in cleat enclosing relationship whereby said cleats are protected by said cover to adapt said bicycle shoe for temporary use as a walking shoe.

2. A cleat cover for use on a bicycle shoe equipped with a pair of bicycle pedal engaging shoe cleats mounted in spaced apart front and rear relationship on a sole plate on the bicycle shoe, each front and rear cleat having a body portion secured to the sole plate and defining a forwardly extending lip overhanging the sole plate, the rear cleat defining a rearwardly directed notch on the body portion substantially adjacent the sole plate, said cleat cover comprising a removable elastomeric shallow cup shaped housing for engaging, covering and protecting said front and rear cleats, said housing comprising a generally oval base and a narrow upstanding peripheral wall extending around the periphery of the base, a transverse wall on said base extending between opposite side walls, said cup-shaped housing defining a parabolic toe portion cup adapted for receiving and covering the front cleat and a generally rectangular heel portion cup adapted for receiving and covering the rear cleat, means defining an arcuate lip integral with said peripheral wall adjacent the front of said parabolic cup, said lip being integral with the forward parabolic wall and overlying the base and defining an arcuate groove therewith adapted to receive the lip on the front cleat, means defining a rearwardly extending lip integral with said transverse wall and extending into said rectangular cup portion overlying said base and defining therewith a transverse groove adapted to receive the lip on the rear cleat, the rear wall of said rectangular cup sloping downwardly and inwardly into said cup, the upper rear edge of said sloping wall defining a forwardly directed rib adapted to releasably engage in the rearwardly directed notch in the body of said rear cleat, the engagement of said front cleat lip, said rear cleat lip, and said rear cleat notch, with said arcuate groove, said transverse groove and said rib respectively, retaining said cover in secure enclosing relationship with said cleats whereby said cleats are enclosed and protected by said cover to adapt said bicycle shoe for temporary use as a walking shoe.

3. A cleat cover for a walking shoe as defined in claim 1 wherein said shallow cup shaped housing defines a generally parabolic cup shaped portion adapted to receive and cover the front shoe cleat and a rectangular shallow cup shaped portion adapted to receive and cover the rear shoe cleat, said rectangular shallow cup snugly retaining said rear cleat to hold said cover on said cleat against relative twisting with respect thereto.

4. A cleat cover as defined in claim 1 wherein the external surface of the base of said cover slopes rearwardly and upwardly to provide a supporting surface when said walking shoe contacts the ground surface.

5. A cleat cover as defined in claim 1 wherein said means for releasably engaging said forwarding extending lips on said front and rear cleats comprises rearwardly extending lips defining rearwardly opening grooves for receiving said forwardly extending cleat lips.

6. A cleat cover as defined in claim 1 wherein said means for releasably engaging said forwardly extending lips on said front and rear cleats comprises a front lip defining a front groove and a rear lip defining a rear groove.

7. A cleat cover for use on a bicycle shoe equipped with a pair of bicycle pedal engaging shoe cleats mounted in spaced apart front and rear relationship on a sole plate on the bicycle shoe, each front and rear cleat having a body portion secured to the sole plate and defining a forwardly extending lip overhanging the sole plate, the rear cleat defining a rearwardly directed notch on the body portion substantially adjacent the sole plate, said cleat cover comprising a removable elastomeric shallow cup-shaped housing for engaging, covering and protecting said front and rear cleats, said housing comprising a generally oval base and a narrow upstanding peripheral wall extending around the periphery of the base, a transverse wall on said base extending between opposite side walls, said cup-shaped housing defining a toe cup adapted for receiving and covering the front cleat and a heel cup adapted for receiving and covering the rear cleat, means within said toe cup defining a lip overlying said base and defining therewith a front groove adapted to receive the lip on the front cleat, means within said heel cup defining a lip overlying said base and defining therewith a rear groove adapted to receive the lip on the rear cleat, said housing having a rear wall defining an upper edge, said upper edge defining a forwardly directed rib adapted to releasably engage in the rearwardly directed notch in the body of said rear cleat, the engagement of said front cleat lip, said rear cleat lip, and said rear cleat notch, with said front groove, said rear groove and said rib respectively, retaining said cover in secure enclosing relationship with said cleats whereby said cleats are enclosed and protected by said cover to adapt said bicycle shoe for temporary use as a walking shoe.

8. A cleat cover for a walking shoe as defined in claim 7 wherein said shallow cup shaped housing defines a generally parabolic cup shaped portion adapted to receive and cover the front shoe cleat and a rectangular shallow cup shaped portion adapted to receive and cover the rear shoe cleat, said rectangular shallow cup snugly retaining said rear cleat to hold said cover on said cleat against relative twisting with respect thereto.

9. A cleat cover as defined in claim 7 wherein the external surface of the base of said cover slopes rearwardly and upwardly to provide a supporting surface when said walking shoe contacts the ground surface.

* * * * *